United States Patent [19]

Wrana

[11] Patent Number: 4,586,439

[45] Date of Patent: May 6, 1986

[54] CARTRIDGE FOR LAUNCHING DECOYS

[75] Inventor: Josef B. V. Wrana, Spånga, Sweden

[73] Assignee: U.S. Philips Corporation, New York, N.Y.

[21] Appl. No.: 605,533

[22] Filed: Apr. 30, 1984

Foreign Application Priority Data

1983 [SE] Sweden ..... 8302510
1984 [SE] Sweden ..... 8402109

[51] Int. Cl.[4] ..... F42B 13/00; F42B 13/50

[52] U.S. Cl. ..... 102/438; 102/357; 102/505

[58] Field of Search ..... 102/217, 334, 364, 346, 360, 340, 342, 351, 352, 357, 438, 439, 345, 489, 505, 430; 89/1.51

[56] References Cited

U.S. PATENT DOCUMENTS 3,899,975 8/1975 Lawrence ..... 102/505
4,019,421 4/1977 Strom ..... 89/1.51
4,135,455 1/1979 Wallace ..... 102/505
4,178,854 12/1979 Schillreff ..... 102/505
4,391,197 5/1983 Jacobsen et al. ..... 102/334
4,399,752 8/1983 Bowyer et al. ..... 102/217

FOREIGN PATENT DOCUMENTS 7514020 11/1981 Sweden .
1534134 11/1978 United Kingdom ..... 102/505

*Primary Examiner*—Harold J. Tudor
*Attorney, Agent, or Firm*—Thomas A. Briody; William J. Streeter

[57] ABSTRACT

The invention relates to a cartridge (1) for launching decoy material, for example chaff. The cartridge (1) contains several cassettes (11, 12, 13, 14), each cassette containing several payloads (15) with chaff or other passive and active decoys. An electronic ignition signal device (5) ensures that the payloads (15) and the cassettes (11, 12, 13, 14) may be launched in an arbitrary sequence. By means of the invention a compact cartridge is obtained which may contain a great number of payloads (10) and which has a high reliability.

4 Claims, 4 Drawing Figures

CARTRIDGE FOR LAUNCHING DECOYS

BACKGROUND OF THE INVENTION

The present invention relates to a cartridge for launching decoy material, comprising sets of decoy payloads arranged along the longitudinal direction of the cartridge.

Decoy material is understood to include material which reflects electromagnetic waves like radar waves, infrared waves, sonor waves, microwaves, and flares etc.

Cartridges containing cassettes with more than one decoy payloads are previously known from U.S. Pat. No. 4,178,854 and published Swedish patent application 7514020-2.

The U.S. patent describes a rocket type cartridge with a frangible wall which is sectionally split by explosives for each payload unit. The payload sections of each payload unit are blown outwardly in a radial direction by explosives. Further explosives are used to disperse the decoy material from the sections. The known cartridge is relatively complicated and volatile because of the necessity of splitting the cartridge wall and there is a substantial risk of damaging the decoys. A further drawback is that there is no way to control the ejection of the sections of a payload unit in an arbitrary time sequence. But instead all of the sections of each payload unit are blown away simultaneously. A still further drawback is that the payload units must be located in a rocket to effect movement of the sections in the longitudinal direction of the cartridge in order to obtain the desired character of the dispersion.

The Swedish patent application describes a cartridge having payloads arranged one behind the other in the ejction direction. The payloads are ejected one by one in a sequence determined by their positions relative to the exit of the cartridige. One drawback of this cartridge is that there is no possibility to choose payloads for ejection. The payload situated closest to the exit must always be ejected first, even if a different type of decoy would create the counter-measure effect needed. Another drawback of this cartridge is that it only contains a very limited number of payloads. A great number of payloads in a row would make it difficult to obtain a reliable ejection of the payloads, and the cartridge would not have a suitable length. Among other consequences, the elongated transmission network of conductors and connecting devices required would contribute to the unreliability of such an elongated cartridge.

SUMMARY OF THE INVENTION

It is an object of the present invention to provide a reliable cartridge which is well fitted for stationary use on airplanes wherein the above mentioned drawbacks are avoided. Accordingly the cartridge according to the invention is characterized in that each set of decoy payloads is included in a respective cassette. A cassette and its payloads are connected to individual igniters which are connected to an electronic ignition signal device by means of which the different payloads of a cassette are ejectable from the cassette in an arbitrary time sequence and in the longitudinal direction of the cartridge. Afterwards, the empty cassette is ejected in the longitudinal direction of the cartridge.

Another object of the invention is to obtain a simple and reliable coupling between the individual igniters and the electronic ignition signal device. Accordingly the invention is further characterized in that the payload igniters of a cassette and the cassette igniter itself are connected to the electronic ignition signal device on one side via individual conductors and on the other side via a conductor common to all payloads. In order to obtain a still more simple and reliable coupling the invention is furthermore characterized in that the individual conductors of a cassette are combined into a set of conductors which are common to all cassettes.

Still another object is to facilitate the electrical decoupling of the conductors. Accordingly the invention is furthermore characterized in that the conductors are provided with a frangible part at a position between the igniters of one cassette and the igniters of an adjacent cassette.

The cartridge according to the invention has the following advantages and characteristics:

- a selectable time delay between subsequent firings of the cassettes and payloads which may be electronically controlled by suppling pulse trains to the electronic ignition signal device
- a simple and rapid loading operation of cassettes with payloads
- a good environmental resistance
- a reusable cartridge.

The envelope of the cartridge and the electronic ignition signal device is reusable, thus maximizing cost effectiveness.

BRIEF DESCRIPTION OF THE DRAWING

The invention will be described in more detail below by means of an embodiment with reference to the drawing, where.

DESCRIPTION OF THE PREFERRED EMBODIMENTS

Figure 1:
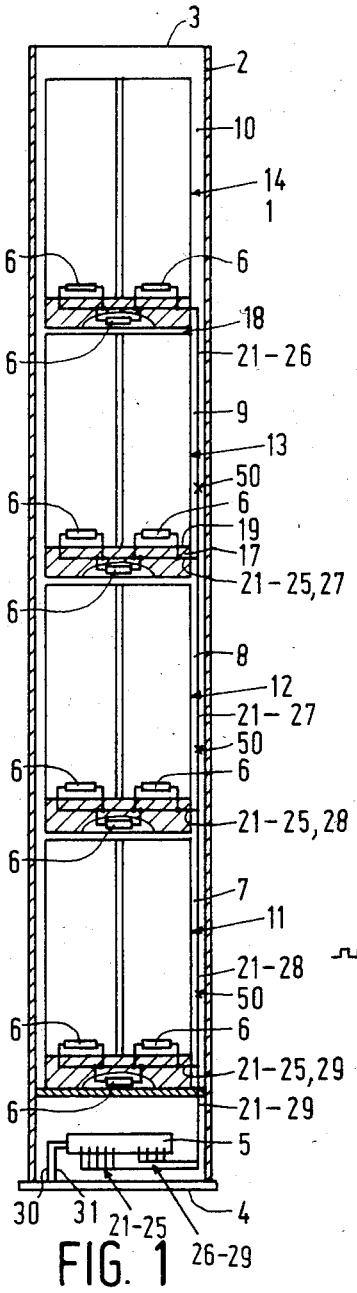
FIG. 1 shows a schematic longitudinal section of a cartridge according to the invention accommodating four cassettes.

The cartridge 1 according to FIG. 1 comprises a circular cylindrical envelope 2 with a launching opening 3 and a bottom plate 4. The bottom plate 4 is provided with a connecting device (not shown) for external connections. The connecting device may consist of concentrically arranged contact rings separated by electrically isolated areas as described in U.S. Pat. No. 4,019,421. An electronic signal ignition device 5 arranged on the bottom of the cartridge 1, said device being electrically connected to the connecting device via conductors 30, 31 and to igniters 6 via conductors 21–29.

Figure 2:
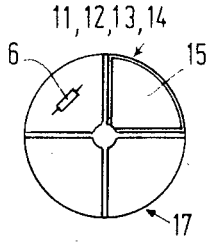
FIG. 2 shows a top view of a cassette containing four payloads.

In the embodiment shown the cartridge comprises four compartments 7, 8, 9 and 10 containing cassettes 11, 12, 13 and 14, respectively which are slidable in the envelope 2. Each cassette may (see FIG. 2) comprise four parallel payloads 15. For the sake of clarity only one pyaload is shown in FIG. 2. The longitudinal direction of the payloads 15 is parallel to the longitudinal direction of the cartridge 1. Each of the payloads 15 is launchable by a pyro-electric igniter/booster charge 6. Further, igniter/booster charges 6 are arranged to act directly on the cassettes 11, 12, 13 and 14, respectively. The igniter and booster charge 6 of the cassette 11 situated closest to the bottom plate 4 in the cartridge 1 may be omitted if this cassette is not to be lauched. The payload igniters and booster charges may be disposed in a cassette bottom 17 and may comprise powder or similar explosive material. A separate so-called drive mirror (not shown) in the shape of a plate such as a plastic board may be disposed between each of the payloads 15 and the corresponding igniter 6. Each cassette bottom 17 may serve as a so-called drive mirror for the igniter acting directly on the cassette. The last mentioned igniter may be disposed between a cassette bottom 17 and the underlying cassette with payloads. The continuous line 18 in FIG. 1 denotes the upper part of a cassette, while the continuous line 19 denotes the bottom of the space for the decoy material (for example chaff) of the payloads.

Figure 3:
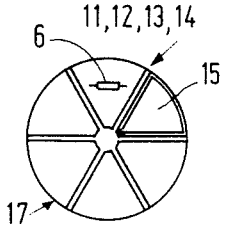
FIG. 3 shows a top view of an alternative embodiment of a cassette containing six payloads.

The shape of the payloads as well as the number of payloads contained in a cassette may be different. As shown in FIGS. 2 and 3, the payloads 15 may have the shape of a circle sector. The decoy material in the payloads 15 may have different jamming characteristics.

Figure 4:
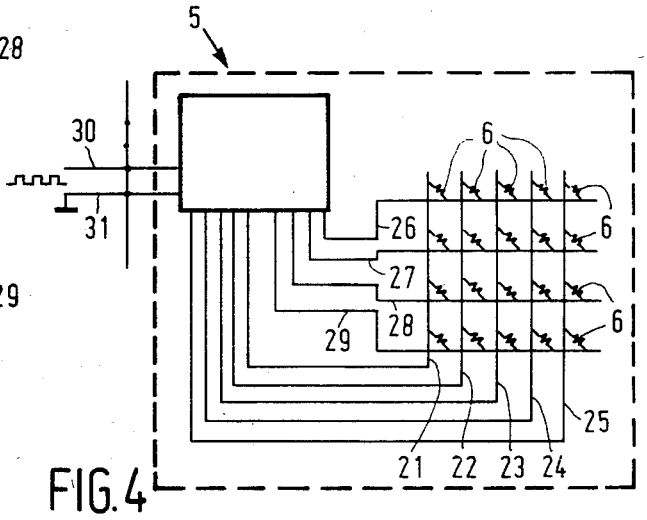
FIG. 4 shows an electrical circuit coupling the electronic signal ignition device to the igniters of the cassettes and the payloads.

The connections of the igniters 6 to the electronic ignition signal device 5 is shown in FIG. 4 for a cartridge with four cassettes, each cassette containing four payloads. In the embodiment according to FIG. 1 the cartridge 1 comprises four cassettes 11, 12, 13 and 14, each cassette containing four payloads 15. Each cassette comprises four payload igniters and one cassette igniter. The four payload igniters 6 of cassette 11 are according to FIG. 4 connected to the electronic ignition signal device 5 by means of four input conductors 21, 22, 23 and 24. The cassette igniter 6 of cassette 11 is connected to device 5 by input conductor 25. All five igniters associated with cassette 11 are connected to the device 5 by a common output conductor 29. The four payload igniters 6 of cassette 12 are connected to the device 5 by means of the four input conductors 21, 22, 23 and 24. The cassette igniter 6 of cassette 12 is connected to device 5 by input conductor 25. All five igniters associated with cassette 12 are connected to the device 5 by a common output conductor 28. The four payload igniters 6 of cassette 13 are connected to the device 5 by means of the four input conductors 21, 22, 23 and 24. The cassette igniter 6 of cassette 13 is connected to device 5 by input conductor 25. All five igniters associated with cassette 13 are connected to the device 5 by a common output conductor 27. The four payload igniters 6 of cassette 14 are connected to the device 5 by means of the four input conductors 21, 22, 23 and 24. The cassette igniter 6 of cassette 14 is connected to device 5 by input conductor 25. All five igniters associated with cassette 14 are connected to the device 5 by a common output conductor 26. Input conductors 21, 22, 23, 24 are thus common to one payload igniter of all cassettes and input conductor 25 is common to all cassette igniters.

In order not to inhibit the launching of cassettes, because of input and output conductors which extend over the height of the cartridge 1, input conductors 21, 22, 23, 24 and 25 as well as output conductors 26, 27 and 28 are provided with frangible parts 50 (schematically shown in FIG. 1) at a position along the compartments 7, 8 and 9. Frangible parts 50 may be kerfs in a connection cable. When an emptied cassette is ejected, the connection cable is torn off at the appropriate location by the ejection force. The connection cable is provided with extra isolation material (not shown) around a kerf. In this way the remaining cable end will remain electrically isolated after each cassette ejection. The connection cables or the connection wires are combined in a flexible flat cable with kerfs at appropriate locations. Due to lack of space in FIG. 1 several input and output conductors are indicated by a single line. The reference numerals make clear that more than one conductor is included.

The supply of igniting current to the igniters may be controlled by means of a pulse train applied to the cartridge via its connecting device to the device 5. Each pulse in the pulse train may correspond to firing of one payload. The 5th, 10th, 15th and 20th pulses initiate launching of emptied cassettes, in which previously launched payloads were stored. Dependent on the shape of the pulse train, the device 5 may initiate the ejection of payloads with selectable time delays between different ejections. Electronic control of the launching of the payloads is possible by using a programmable electronic ignition signal device.

Activation from outside the device 5 may includes a scan to detect the presence of a selected igniter in the cartridge. First the igniters situated closest to the cartridge opening 3 are scanned and then the igniters situated closer and closer to the cartridge bottom 4 are scanned. When the first igniter for a selected type of payload (e.g. chaff) has been found, it is fired. Simultaneously, a sensor may detect whether a firing has taken place. In the event that no firing has taken place, the firing sensor may ensure that a further igniter is fired, so that increased reliability is obtained.

I claim:

1. A cartridge for launching decoy material, said cartridge comprising:

(a) a tubular envelope having a launching end from which the decoy material is to be ejected;

(b) a plurality of tubular cassettes longitudinally-arranged in the envelope, each cassette having a launching end from which decoy payloads are to be ejected;

(c) a first plurality of electrically-triggered igniters, each disposed at an end of a respective one of the cassettes remote from the launching end of the envelope for effecting ejection of the cassette from the envelope;

(d) a plurality of the decoy payloads, arranged transversely with respect to each other, in each cassette;

(e) a second plurality of electrically-triggered igniters, each disposed at an end of a respective one of the payloads remote from the launching end of its respective cassette for effecting ejection of the payload from the cassette; and (f) an electronic signal ignition device electrically-connected to the igniters, said device including means for selectively triggering the igniters and thereby selectively ejecting the respective payload or cassette associated with any triggered igniter.

2. A cartridge as in claim 1 where each of the igniters includes first and second electrical connection points for connection to the electronic signal ignition device, the first points of all igniters being electrically connected to the device by a common conductor, and the second connection point of each igniter being electrically connected to said device by a respective individual electrical conductor.

3. A cartridge as in claim 2 where the individual electrical conductors electrically connected to the igniters associated with each cassette and its associated payloads are electrically connected to respective ones of the individual electrical conductors for the other cassettes and their associated payloads.

4. A cartridge as in claim 2 or 3 where any of the electrical conductors which extend beyond the launching end of a cassette includes a frangible portion adjacent said launching end for effecting separation of the conductor when a cassette to which it is connected is ejected from the envelope.

* * * * *